US007597455B2

(12) United States Patent
Smith et al.

(10) Patent No.: US 7,597,455 B2
(45) Date of Patent: Oct. 6, 2009

(54) LED LIGHT BULB SYSTEM

(75) Inventors: Robert B. Smith, 3705 Woodburn Rd., Annandale, VA (US) 22003; Norman J. Shenton, 989 Fall Circle Way, Gambrills, MD (US) 21054; Jon L. Roberts, Great Falls, VA (US)

(73) Assignees: Robert B. Smith, Annandale, VA (US); Norman J. Shenton, Gambrills, MD (US)

( * ) Notice: Subject to any disclaimer, the term of this patent is extended or adjusted under 35 U.S.C. 154(b) by 0 days.

(21) Appl. No.: 11/876,109

(22) Filed: Oct. 22, 2007

(65) Prior Publication Data

US 2008/0092800 A1 Apr. 24, 2008

Related U.S. Application Data

(63) Continuation-in-part of application No. 11/584,157, filed on Oct. 20, 2006, now abandoned.

(51) Int. Cl.
*F21S 4/00* (2006.01)

(52) U.S. Cl. ..... 362/249.01; 362/310; 362/267

(58) Field of Classification Search ..... 362/249, 362/267, 310, 237, 249.01, 249.02; 340/815.4–815.49, 340/815.52, 815.56, 815.6, 815.65–815.67, 340/815.69

See application file for complete search history.

(56) References Cited

U.S. PATENT DOCUMENTS

| | | | | |
|---|---|---|---|---|
| 4,298,869 | A | 11/1981 | Okuno | |
| 4,427,974 | A | 1/1984 | Sheahan | |
| 5,463,280 | A | 10/1995 | Johnson | |
| 5,726,535 | A | 3/1998 | Yan | |
| 5,949,347 | A | 9/1999 | Wu | |
| 6,244,728 | B1 * | 6/2001 | Cote et al. | 362/249 |
| 6,499,860 | B2 | 12/2002 | Begemann | |
| 6,621,222 | B1 | 9/2003 | Hong | |
| 6,744,223 | B2 | 6/2004 | Laflamme et al. | |
| 7,218,056 | B1 | 5/2007 | Harwood | |
| 7,255,457 | B2 | 8/2007 | Ducharme et al. | |
| 2004/0007993 | A1 * | 1/2004 | Weng | 315/294 |
| 2004/0212321 | A1 * | 10/2004 | Lys et al. | 315/291 |
| 2007/0121319 | A1 | 5/2007 | Wolf et al. | |

FOREIGN PATENT DOCUMENTS

| | | | |
|---|---|---|---|
| CN | 1690506 | A | 11/2005 |
| WO | WO 2005/003625 | A1 | 1/2005 |

* cited by examiner

*Primary Examiner*—Jong-Suk (James) Lee
*Assistant Examiner*—Julie A Shallenberger
(74) *Attorney, Agent, or Firm*—The Marbury Law Group, PLLC

(57) ABSTRACT

An LED light bulb having separately addressable groupings of LED's. The LED light bulb can serve as a visual indicator of emergency or non-emergency conditions by selectively illuminating groupings of LED's in a variety of colors, each color corresponding to a predetermined condition.

7 Claims, 4 Drawing Sheets

LED LIGHT BULB SYSTEM

This application is a continuation in part of application Ser. No. 11/584,157 filed Oct. 20, 2006 now abandoned which is herein incorporated by reference in its entirety for all purposes.

FIELD OF THE INVENTION

This disclosure relates generally to signal lights using light emitting diodes (LED's) to convert electrical energy into light energy.

BACKGROUND INFORMATION

Light emitting diodes are becoming increasingly prevalent for a variety of lighting functions. They are low cost in terms of use electricity, and now come in a variety of different colors. Not only are they useful in flashlights and automotive uses, but they find additional uses on a regular basis since their cost to operate, brightness, and low heat generation make them useful in a variety of applications.

It would be useful to have an LED light bulb that may be used in emergency and non-emergency situations to visually identify a condition of interest, and optionally identify that condition with a particular building, or room within a building.

SUMMARY OF THE INVENTION

One embodiment is a light emitting diode (LED) light bulb. The LED light bulb has multiple groupings of LED's. One LED grouping can have plural LED's that all have a particular light color that is associated with a condition. Another LED grouping has plural LED's that all have a different light color, which is different from the other light colors and is associated with a different condition. The LED light bulb also has control circuitry that selectably addresses the different LED groupings with a supply of electrical power depending upon the condition. A threaded base is connected to supply the control circuitry with electrical power when screwed into a light socket. An envelope connects to the base to house the first LED grouping and the second LED grouping.

Another embodiment is also a LED light bulb. The LED light bulb has multiple LED boards. One LED board bears plural LED's that all have a particular light color. Another LED board bears plural LED's that all have a different light color. The LED light bulb also has control circuitry that is connected to selectably address the LED boards with a supply of electrical power. A threaded base is connected to supply the control circuitry with electrical power when screwed into a light socket. An envelope connects to the base to house the LED boards.

Still another embodiment is another light emitting diode (LED) light bulb. The LED light bulb has multiple groupings of LED's. Each LED grouping has plural LED's that all have a similar light color that is associated with a given condition. Other LED groupings have plural LED's that all have a similar light color (different from other groupings), and which is associated with a different condition. The LED light bulb also has control circuitry that is connected to selectably address the different LED groupings or with a supply of electrical power depending upon the condition. In this embodiment a wireless receiver is connected to command selectable address by the control circuitry based upon a received RF signal. A threaded base is connected to supply the control circuitry with electrical power when screwed into a light socket. An envelope connects to the base to house the different LED groupings.

Yet another embodiment is an emergency alert system. The emergency alert system has first and second alarm sensors. The first alarm sensor is adapted to sense a first emergency condition. The second alarm sensor is adapted to sense a second emergency condition, which is different from the first emergency condition. The emergency alert system also has a system controller connected to receive sensor signals from the first and second alarm sensors and connected to transmit an alarm signal to a command center indicating the first emergency condition or the second emergency condition. The emergency alert system further has a signal conditioner connected to receive an illumination signal from the system controller indicating a first light color corresponding to the first emergency condition or a second light color corresponding to the second emergency condition, the second light color being different from the first light color. The signal conditioner transmits a command signal to selectably illuminate according to the first light color or the second light color, based upon the received illumination signal. A LED light bulb has first and second LED groupings. The first LED grouping has plural light emitting diodes all having the first light color. The second LED grouping has plural light emitting diodes all having the second light color. The LED light bulb further has control circuitry connected to selectably address the first light emitting diode grouping or the second light emitting diode grouping with supply of electrical power based upon the command signal from the signal conditioner.

The LED light bulb may be implemented with only a single color of LED's or it may have two, three, or more colors of LED's. The number of LED's may vary without departing from the scope of the present invention. Each color (or combination of colors) is associated with a particular condition. For example, and without limitation, emergency conditions and non-emergency conditions may be indicated by different color LED's or combinations thereof, all of which are considered to be within the scope of the present invention.

The embodiments of the LED light bulb may also be used in conjunction with an automated network notification to emergency responders of the existence of an emergency, as well as a visual indication of the location and type of emergency that has been automatically detected.

The use of a standard screw in type power contact configuration enables the LED light bulb to be easily retrofitted into existing light bulb sockets. Thus, no new equipment needs to be installed to make the LED light bulb useful.

In one embodiment, communication between the controller and the LED light bulb is implemented using a wireless connection. According to an alternate embodiment, communication between the controller and the LED light bulb is implemented using existing power wiring and an ×10 protocol (or the like).

DETAILED DESCRIPTION

Figure 1:
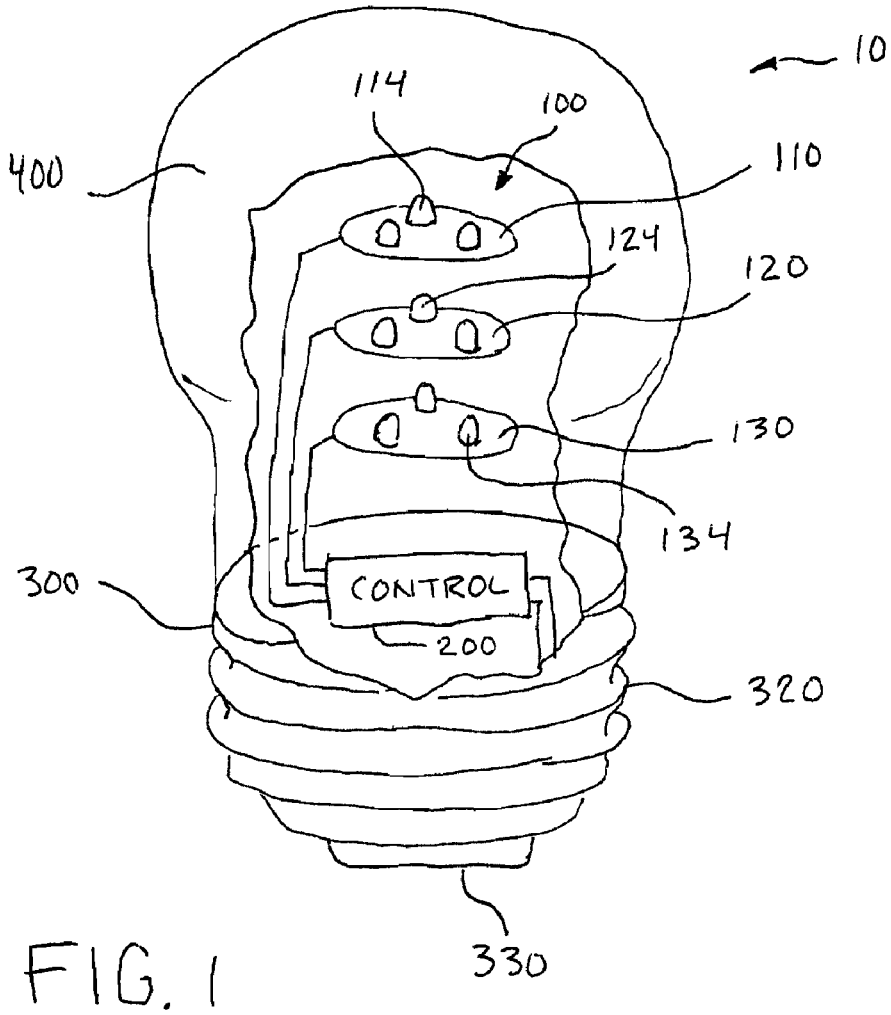
FIG. 1 illustrates a LED light bulb according to a first embodiment with LED color groupings arranged horizontally and stacked atop one another.

Referring to FIG. 1, An LED light bulb 10 according to one embodiment has a light assembly 100 which has plural LED boards 110, 120, 130 stacked atop one another. The LED's 114 on the top LED board 110 all radiate light of the same color as one another and are electrically connected so as to illuminate together as a group. The LED's 124 on the middle LED board 120 all radiate light of the same color as one another, but which is of a different color than that radiated by the LED's 114 of the top LED board 110. The LED's 124 on the middle LED board 120 are electrically connected so as to illuminate together as a group. The LED's 134 on the bottom LED board 130 all radiate light of the same color as one another, but which is of a different color than those radiated by the LED's 114 of the top LED board 110 and the LED's 124 of the middle LED board 120. The LED's 134 on the bottom LED board 130 are electrically connected so as to illuminate together as a group.

Control circuitry 200 is disposed inside the bulb 10 and receives power, and in one embodiment a control signal, via the bulb's base 300. The control circuit 200 controls illumination of the bulb by energizing only one of the LED boards 110, 120, 130, at a given moment. This is accomplished by an addressing circuit that is advantageously implemented as a PIC 16C54 microcontroller. The PIC 16HV540 microcontroller has thirteen input/output (I/O) pins of which twelve are general purpose. These pins are used to address and drive a selected one (or none) of the plural groups of LED's that display light of a selected color characteristic. The PIC is a suitable microcontroller for implementing the invention because it is robust, simple to interface to the outside world, and relatively simple to program.

The control circuitry 200 also includes a power supply circuit that converts the 120 VAC power received via the bulb's base 300 into a DC voltage appropriate to power the microcontroller, as well as the LED's.

Bulb 10 has a bulb base 300 that conforms to the same physical dimensions as any standard sizes for incandescent light bulb that use line voltage. In North America, there are four standard sizes of screw-in sockets used for line-voltage lamps:

E12 candelabra (E10 & E11 in Europe),

E17 intermediate (E14 in Europe),

E26 medium or standard (E27 in Europe), and

E39 mogul (E40 in Europe).

The LED light bulb base 300 may also be configured according to the standard dimensions of so-called "bayonet" type bulbs having a pair or radially opposed prongs, which are used in low power applications.

According to an alternate embodiment, the LED light bulb is hardwired to receive power and control signals rather than interfacing with a conventional socket.

According to another alternate embodiment, the LED light bulb is self-powered with a solar array mounted on the exterior of the bulb and having a battery to store energy gathered via the solar array.

The base 300 has screw threads 320 formed using a conductive (e.g., metal) material. The threads 320 mechanically engage a standard size bulb socket to retain the bulb 10 in the socket. The threads 320 provide conductive connection between the socket and the control circuitry 200. The base 300 also has an electrical foot contact 330 formed using a conductive (e.g., metal) material. The electrical foot contact 330 provides conductive connection between the socket and the control circuitry 200. The threads 320 are electrically isolated from the foot contact 330 by insulation material.

Not only does electrical power enter through the threads 320 and the electrical foot contact 330, but according to at least one embodiment these electrical contact points also serve to couple control signals received via the socket into the control circuitry 200.

Bulb 10 has an envelope 400 that surrounds the LED boards 110, 120, 130. Although illustrated as having a quasi-spherical shape, the envelope 400 may be formed to have any serviceable shape that provides protection to the LED boards 110, 120, 130 and the control circuitry 200 from impact or exposure to ambient conditions (liquids, corrosive materials, salt air, etc.).

The light assembly 100, 102 and the control circuitry 200 are housed inside the combination of the envelope 400 and the threaded base 300. The envelope 400 and the threaded base 300 are integrally joined together to form a protective housing for the internal elements of the bulb. Although a tight fit between the envelope 400 and the threaded base 300 is useful to protect the internal elements of the bulb from ambient conditions, a vacuum seal (as required in incandescent lamps) is not necessary.

The control circuitry 200 is electrically connected to the threads 320 and the foot contact 330 of the base 300 so as to receive both power and control signals. Each of the LED boards 110, 120, 130 connects electrically to the control circuitry 200 to receive electrical power to illuminate addressed groups of the LED's 114, 124, 134. The addressing of the LED's 114, 124, 134 is based upon the control signals received by the control circuitry 200. The control signals may be transmitted via a wireless connection and received via a wireless receiver (explained in detail below) in the control circuitry 200, or it may be transmitted via the line voltage wiring 546 (refer to FIG. 3) and into the base 300 contacts.

In any of the described embodiments, the number of LED boards illustrated is not meant as a limitation. Further the number of colors represented is similarly not meant as a limitation.

Figure 2:
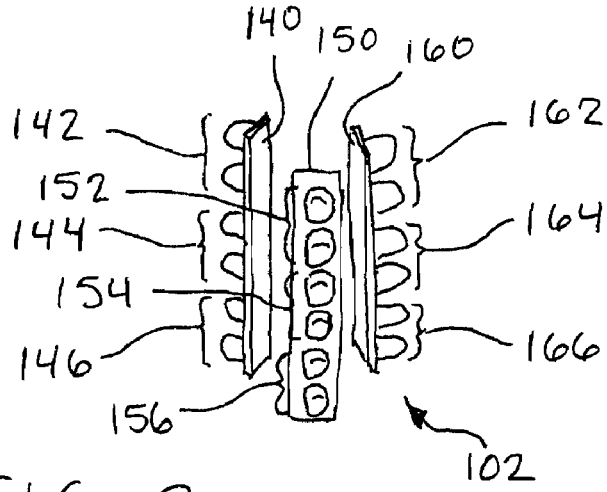
FIG. 2 illustrates a light assembly for a LED light bulb according to a second embodiment with LED's arranged in vertical columns of stacked LED color groupings.

Referring to FIG. 2, a structure is illustrated for how LED's may be successfully arranged inside the bulb using an alternative light assembly 102. This alternative light assembly 102 has plural elongated LED boards 140, 150, 160 arrayed in parallel and facing radially outwards away from one another. The LED groupings 142, 152, 162 on the top portions of each of the elongated LED boards 140, 150, 160 all radiate light of the same color as one another and are electrically connected so as to illuminate together as a group. The LED groupings 144, 154, 164 on the middle portions of each of the elongated LED board 140, 150, 160 all radiate light of the same color as one another, but which is of a different color than that radiated by the top LED groupings 142, 152, 162. The middle LED groupings 144, 154, 164 are electrically connected so as to illuminate together as a group. The LED groupings 146, 156, 166 on the bottom portions of each of the elongated LED board 140, 150, 160 all radiate light of the same color as one another, but which is of a different color than those radiated by the top LED groupings 142, 152, 162 and the middle LED groupings 144, 154, 164. The bottom LED groupings 146, 156, 166 are electrically connected so as to illuminate together as a group.

When powered and controlled to be illuminated, the LED light bulb 10 emits light according to a selected color. For example, the colors may be red, green, and white. These are colors of LED's that are readily commercially available and are easily distinguishable from one another with natural human vision.

Figure 3:
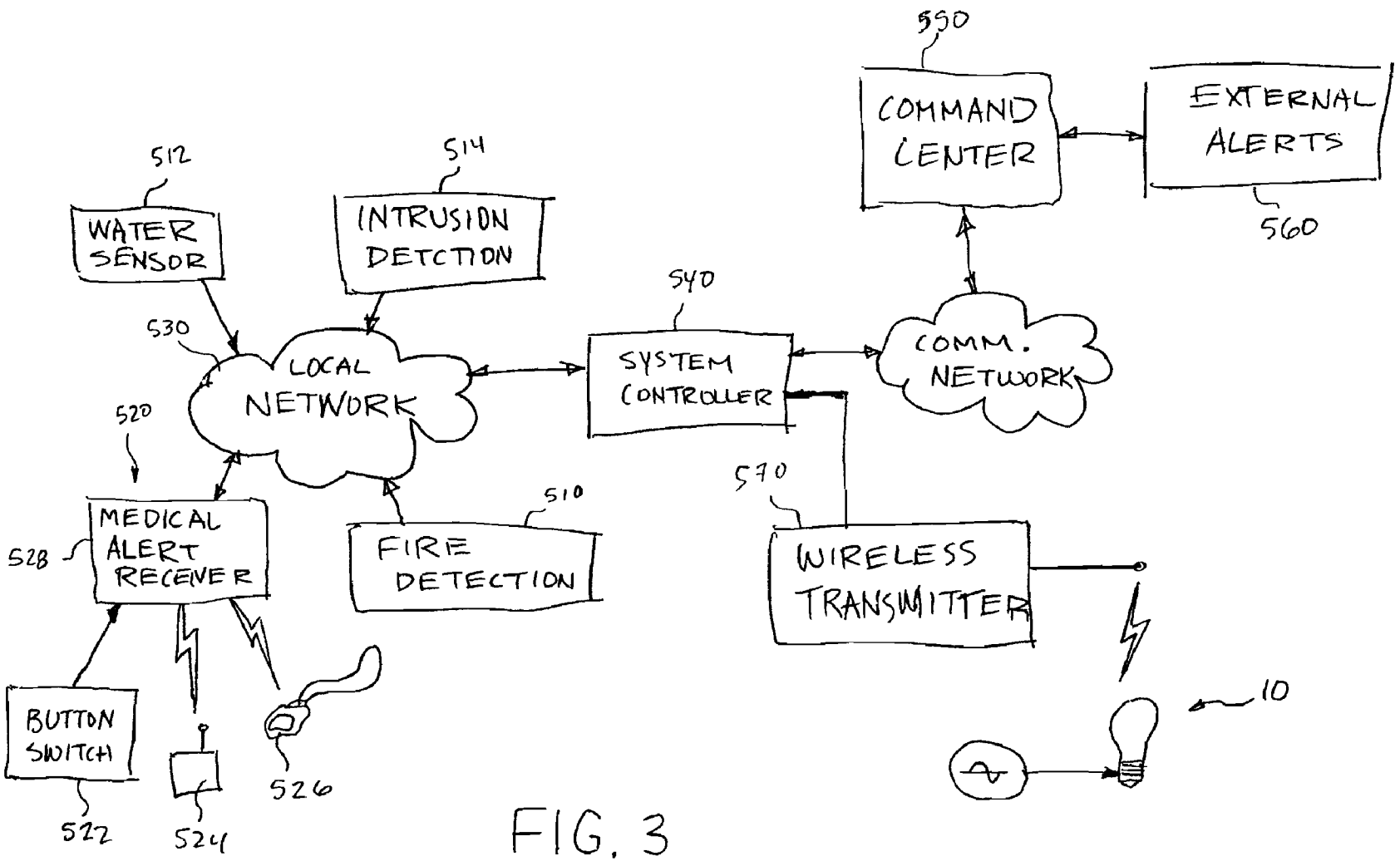
FIG. 3 illustrates a monitoring system that incorporates use of an LED light bulb.

Referring to FIG. 3, a system for providing alerts to emergency personnel approaching a building is illustrated. One or more sensors 510, 512, 514 or signaling systems 520 are connected via a network 530 to a system controller 540. The system controller 540 continuously monitors the sensors 510, 512, 514 and the signaling systems 520 and provides notifications of an alarm condition to a relevant monitoring-dispatching control center 550. The control center 550 relays, either automatically or at human discretion, alerts to external agencies 560 such as fire/rescue, ambulance, or police.

Fire detection sensors 510 for use in this system may be embodied as including (without limitation) smoke detectors, flame detectors, carbon monoxide detectors, or a combination of such detectors. Water detection sensors 512 for use in this system may be embodied as including (without limitation) capacitive sensors, conductive sensors, mechanical float switch sensors, or a combination of such sensors. Intrusion detection sensors 514 for use in this system may be embodied as including (without limitation) magnetic proximity switches, motion sensors, pressure switches, or a combination of such devices.

The system controller 540 also interfaces with a signal conditioner structure that functions to activate the LED light bulb 10. As illustrated in FIG. 3, a wireless transmitter 570 serves as the signal conditioner that sends an addressing signal to the LED light bulb 10 commanding it to display a selected color of light.

When one of the sensors 510, 512, 514 or the signaling system 520 notifies the system controller 540 of an alarm condition, the system controller 540 identifies the type of alarm condition (fire, intrusion, medical, etc.) being sensed and forwards commensurate signals onward to both the command center 550 and the wireless transmitter 570. The system controller 540 sends a signal to the command center 550 that identifies the location of the alarm and the type of alarm condition detected. For example, if a fire condition is sensed the command center 550 is notified of a fire condition at the monitored address. The system controller 540 sends a signal to the wireless transmitter 570 instructing illumination of a color that corresponds to the type of alarm condition detected. For example, if a fire condition is sensed the wireless transmitter 570 is instructed to illuminate with the color red. The wireless transmitter 570 in turn sends a command signal to the LED light bulb 10 to address its red LED's.

Emergency responders receive information in two ways in this system. The responders receive an external alert 560 from the command center 550 telling them the location and nature of the emergency and, when they approach the location of the alarm, they receive signaling from the LED light bulb 10 illuminating to confirm the precise building to respond to. In the case of an apartment building, the LED light bulb 10 will indicate the location of the building and, optionally, which one of the many units in the apartment building the alarm is originating from. Alternatively, the LED light bulb 10 is augmented by a LED digital numeric display 12 that is also activated by the wireless transmitter 570 to indicate the apartment number the alarm is originating from. For example, when the fire alarm in apartment number 872 is activated, the LED light bulb 10 indicates the building and the LED numeric display 12 indicates that apartment number 872 is the source of the alarm.

When the system controller 540 receives a notification of an alarm from one of the sensors 510, 512, 514 or from an alert device 522, 524, 526 via the network 530, or by monitoring of the telephone 544 line (dial of 911) or dry contact closure 548 from an additional unspecified sensor, the system controller 540 send serial data to the wireless transmitter 570. The format of the serial data may advantageously take the form:

| | |
|---|---|
| First word | Sync Word |
| Second word | Unit ID Word (System controller and LED Light Bulb must have the same Unit ID, for Led Bulb to be activated) |
| Third word | Strobe ON or OFF word |

The wireless communication link between the system controller 540 and the LED light bulb 10 can be tested using the telephone. The operator will remove the hand set of the telephone 544 (sometimes referred to as an "off-hook" condition) that the system controller 540 is monitoring and dials the test code (for example, #88). The system controller 540 will decode the buttons pushed on the phone and transfer the flash ON code to the LED light bulb 10.

The LED light bulb 10 will decode the Sync Word to determine the start of the transmission then verify that the ID Word received is equal to (i.e., matches) the ID Word it has been set to. If the ID Words match the LED light bulb 10 will act on the third word received, either Flash On or Flash OFF.

To turn the Flash OFF after an emergency condition has been ended or verification that the wireless link is working, the operator will remove the hand set of the telephone 544 that the system controller 540 is monitoring and dials a Stop/Reset code (for example, #55). The system controller 540 will decode the buttons pushed on the phone and transfer the Flash OFF code to the LED light bulb 10.

Implementation of the wireless link embodiments can be accomplished using any of various commercially available RF transmitters and receivers hardware. Most any RF transmitter as known in the prior art may be used, since size and power constraints are not a concern at the system controller 540. On the other hand, at the LED light bulb 10 a compact receiver is useful to fit inside a light bulb form factor package.

EXAMPLE 1

As a working example, a system controller, wireless transmitter, and LED light bulb wireless receiver have been successfully implemented utilizing RF transmitters and receivers manufactured by LINX Technologies. The LINX RF transmitters and receivers operate on two (2) different carrier frequency ranges depending on the models selected: the low range (nominally 400 MHz) operates at available frequencies including 315, 418 and 433 MHz, and the high range (nominally 900 MHz) operates at available frequencies including 869 and 916 MHz. These devices convert the serial TTL Data stream into RF impulses to be transferred between the two transmitter and receiver components.

Examples of LINX Technologies manufactured RF receivers of the sort that can be advantageously implemented are receiver model numbers RXM-869-ES (nominally 869 MHz) and RXM916-ES (nominally 916 MHz). Alternatively, receiver model numbers RXM-416-LR or LC (nominally 416 MHz) can be used if lower range frequency use is desired. These models have ultra-compact SMD packages and are set up to perform both analog frequency modulation (FM) and digital frequency shift keying (FSK). These models have high noise immunity, excellent sensitivity, and consume little power. No additional components or tuning are required, other than to provide an antenna of the appropriate impedance (nominally 50 Ω) at the selected operating frequency. These models can operate under conditions as hot as 70° C. and require a regulated power supply of nominal 5 VDC with noise of less than 20 mV. They provide a range of up to 1,000 feet outdoors and up to 500 feet indoors, which is more than plenty for residential applications.

For additional technical details the component manufacturer, LINX Technologies, may be contacted at 575 S.E. Ashley Place, Grants Pass, Oreg. 97526.

EXAMPLE 2

As an additional example, the wireless transmitter and receiver components of the disclosed embodiments can be implemented using an RF modem transceiver system, made by Xecom Inc., which operates on AT commands. When data is to be transferred from one modem to the other or a multi-point RF network, the initiating device makes the connection then sends the data. The distant receiving end then sends back to the initiating end an acknowledgment that the data was received error free.

Examples of Xecom Inc. manufactured RF transceivers of the sort that can be advantageously implemented are model numbers XE900SL10 (low power) and XE900S-500 (high power). These models have compact packages that house spread spectrum transceiver and integrated micro-controller that manages a frequency hopped spread spectrum link and a host system interface. These models each have −100 dBm receiver sensitivity, can operate at temperatures as high as 85° C., require a nominal 3.3 Volt power supply, and operate in a frequency band of about 902 through 928 MHz. The lower power XE900SL10 model has package dimensions of 1 inch square with a 0.26 inch thickness, and has an obstructed signal range of 300 feet. The higher power model has package dimensions of 1.295 inch by 1.410 inch by 0.255 inch, and has an obstructed signal range of 1000 feet.

For additional technical details the component manufacturer, Xecom Inc., may be contacted at 3374 Turquoise Street, Milpitas, Calif. 95035.

EXAMPLE 3

When a life threatening emergency occurs, fast response time by emergency personnel is important. Although response times have been shortened substantially via automated alarm systems that provide timely alerts to emergency services organization, many deaths associated with delayed response times are attributable to difficulties in locating the right house, apartment, or business location in a timely manner when responding to emergency calls. Despite rigorous training of emergency personnel to attempt to improve the speed of location of emergency locations, this remains a stubbornly hard-to-eliminate source of delay. Embodiments of the LED light bulb herein described allow responders to quickly find the emergency location via the LED color that is visible.

EXAMPLE 4

Other embodiments of the LED light bulb may be manually activated in a particular color by a user command. In such a case, a particular color might mean the home is open to "trick-or-treaters" or is a location where pets are located. In summary, the invention can signify any of various non-emergency conditions.

EXAMPLE 5

An LED light bulb provides signaling regarding various alarm conditions. Each alarm condition is represented by a distinct color profile of light emitted by the LED light bulb. The power connection contacts of the LED bulb are consistent with a standard screw-in type light bulb, although this is not meant as a limitation and other connection interfaces may be used to practice the present invention. The use of a standard screw-in type light bulb base configuration is useful to retrofit the novel structure and function of the present invention easily with existing lighting systems. The bulb incorporates an integrated circuit chip that receives and decodes control signals concerning what signals the LED light bulb is to make. Based on the decoded control signals, the integrated circuit chip controls application of power to a selected one of plural groups of LED's housed inside the bulb. Each of the plural groups of LED's is of a particular color emission characteristic that is distinct from the other LED groups.

EXAMPLE 6

The LED light bulb can function as part of a security system. Typically a network connects various monitoring subsystems, such as burglary detectors, fire/smoke detectors, medical alert monitors, water intrusion monitors, carbon monoxide sensors, etc. A central controller connects to these various subsystems via the network and provides alert signals to both a remote command center and to one or more of the LED light bulbs at, or near, the premises being monitored. Whereas the remote command center has the discretionary capability to summon emergency personnel (firefighters, police, private security, etc.) the LED light bulbs provide a local visual alert to building occupants, neighbors, passersby, and intruders of an alarm condition.

EXAMPLE 7

Each of the colors of the LED light bulb may be used to designate a particular condition of either an emergency or non-emergency nature, and when mounted on the exterior of a building (residential or commercial) provides to first responders or passersby information about the nature of the condition, in addition to providing a conspicuous indication of the location of the condition. For example when used in an emergency situation, red might symbolize a fire alarm, green would symbolize a medical alarm (e.g., from a medical alert transmitter), and white would symbolize an intrusion alarm. Other colors may indicate yet other conditions. The illumination may be continuous or modulated to indicate further information, and the frequency and duty cycle of modulation (slow blink, fast blink, strobe, etc.) can also convey information.

Figure 4:
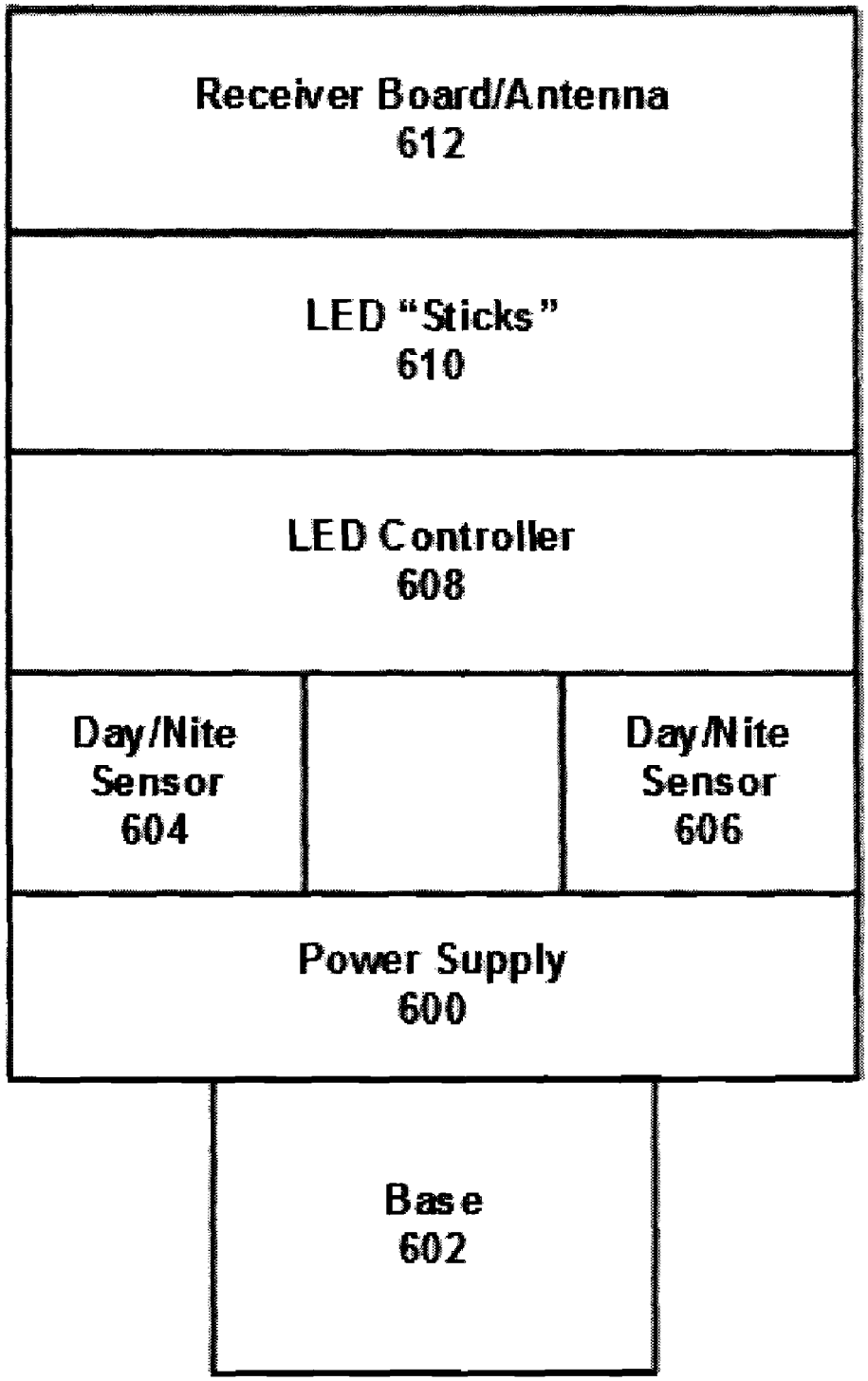
FIG. 4 illustrate an LED bulb embodiment

Referring to FIG. 4 a preferred embodiment of the LED light bulb is illustrated. The LED bulb comprises a base 602 that can be a screw type base, pin base, or any other type of base known in the art that allows connection of the bulb to an electrical system. The base 602 provides power to the power supply 600 which in turn provides power to the remainder of the LED bulb embodiment. Day/night sensors 604, 606 allow the bulb to sense the ambient light and therefore provide greater or lesser power as needed. Once the outside illumination falls below a certain level the day/night sensors will permit the LED bulb to be turned on at a preset level which will not affect the later control or operation of the LED bulb. LED controller 608 is disposed over the power supply and allows both intensity, duration of the flash, and time interval for sequential flashes of the LEDs to be controlled. This controller then controls the LED "sticks" 610. In a preferred embodiment the LED are disposed in a vertical stick-type arrangement with 8 sticks of LED's connected to the controller. Each stick has 4 LEDS although this is not meant as a limitation. A receiver board/antenna 612 is disposed on top of the LED sticks, although this physical position is not a limitation. The receiver board/antenna 612 allows the LED bulb to receive signals from a wireless controller that instructs the LED bulb to glow in a particular color, to flash in a particular manner, or to operate in other way disclosed herein.

Figure 5:
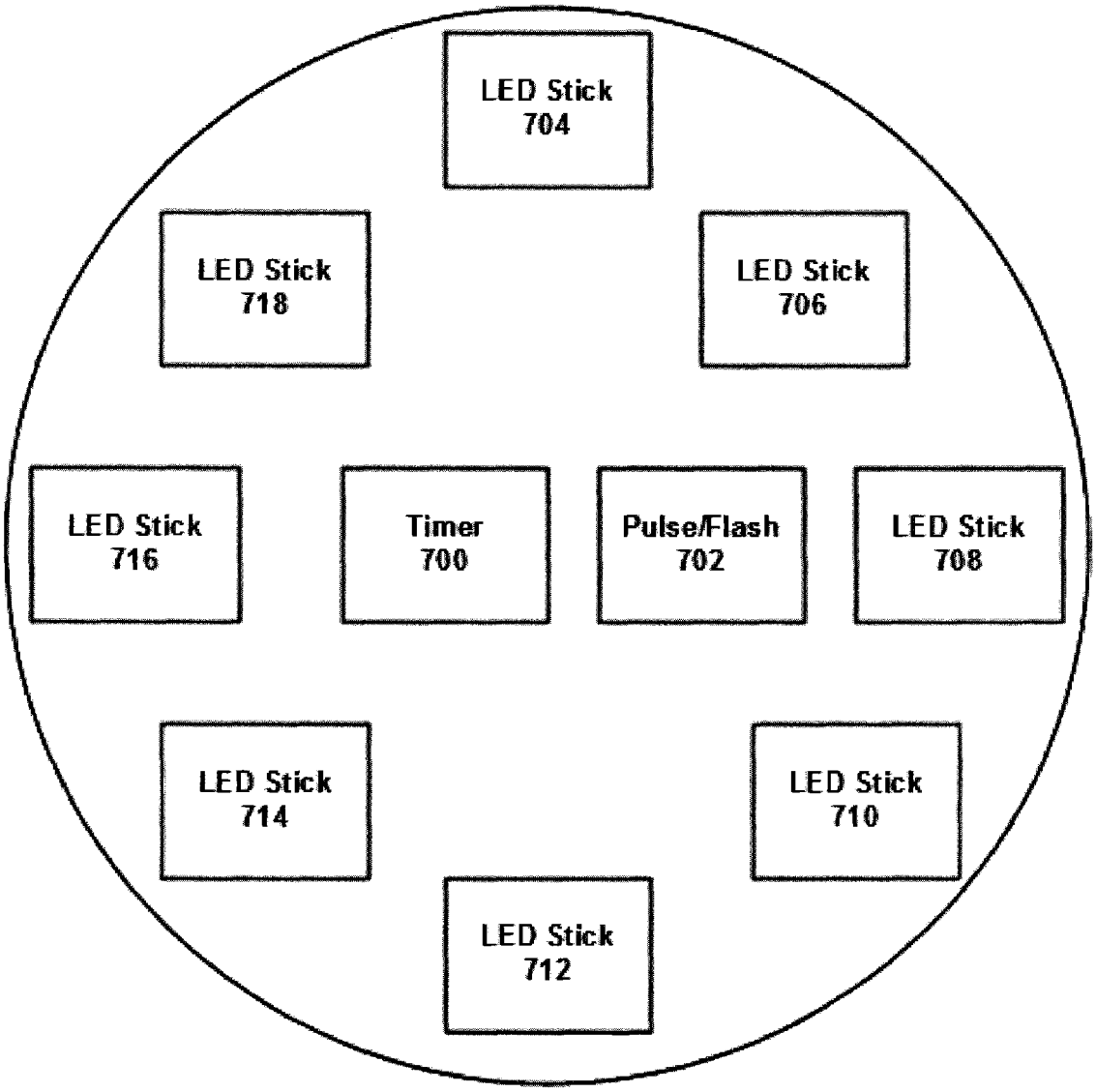
FIG. 5 illustrates an LED bulb and controller circuit layout.

Referring now to FIG. 5 a vertical view looking down on the LED bulb is illustrated. Note that the antenna board is not seen in this view. Timer circuit 700 controls the LED sticks 704, 706, 708, 710, 712, 714, 716, and 718. The timer determines the interval with which the LED sticks will flash (i.e., once every second, sequentially, color, and in other ways disclosed herein). The pulse/flash controller circuit 702 controls the intensity with which the LED sticks will flash at the predetermined interval controlled by the timer circuit 700.

This particular layout of LED sticks and controlling circuits is not meant as a limitation. It is illustrated herein for this particular embodiment.

The embodiments are not limited to the number of colors specifically disclosed, nor to the specific colors mentioned. Practice of the present invention may be effected with as few as one single color of LED in the light bulb, although plural colors are preferred to provide increased versatility. The colors of LED's usable to practice the invention are not limited to those currently commercially available and shall be considered to encompass wavelengths and ranges of wavelengths that may come to be produced in the future. The colors of LED's usable to practice the invention are not limited to visible wavelengths and may include infrared and ultraviolet varieties, for example, for producing radiative alerts that trigger remote sensors or for producing stealthy alerts detectable only to emergency personnel with appropriate equipment to sense non-visible alerts.

An LED light bulb and an emergency alert system have been described using the LED light bulb. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A method for controlling a light emitting diode (LED) light bulb system, wherein the LED light system comprises a system controller having a wireless transmitter, an LED bulb apparatus comprising a wireless receiver for receiving signals from the system controller, an LED grouping of plural LEDs, control circuitry connected to the LED grouping for effecting a desired illumination condition of the LED grouping, a power supply for conditioning and powering the control circuitry, and the LED bulb apparatus connected to a power source, comprising monitoring a telephone line using the controller to detect removing the hand set of a telephone, which is the off-hook condition;

listening on the telephone line, using the controller, for a code when the off-hook condition is detected;

receiving the code at the controller, wherein the code is indicative of a desired illumination condition;

translating the code into instructions by the controller; and transmitting the instructions to the wireless receiver of the LED bulb apparatus via the wireless transmitter to effect the desired illumination condition.

2. The method of claim 1, wherein the LED grouping comprises plural elongated boards, the plural elongated boards being disposed generally parallel to one another.

3. The method of claim 2, wherein the LED boards comprise LEDs of a plurality of colors.

4. The method of claim 2, wherein transmitting the instructions to the wireless receiver of the LED bulb apparatus via the wireless transmitter to effect the desired illumination condition comprises transmitting the instructions to the wireless receiver of the LED bulb apparatus via the wireless transmitter to apply power selectably to the plural elongated boards.

5. The method of claim 4, wherein the LED boards comprise LEDs of a plurality of colors.

6. The method of claim 1, wherein receiving the code comprises receiving the code from a sensor.

7. The method of claim 1, wherein the code is indicative of an emergency condition and wherein transmitting the instructions to the wireless receiver of the LED bulb apparatus via the wireless transmitter to effect the desired illumination condition comprises transmitting the instructions to the wireless receiver of the LED bulb apparatus via the wireless transmitter to effect an illumination condition associated with the emergency condition.

* * * * *